US005514844A

United States Patent [19]

Hamano et al.

[11] Patent Number: 5,514,844

[45] Date of Patent: May 7, 1996

[54] SWITCH

[75] Inventors: Suenobu Hamano; Hiroyuki Sasao; Katsuhiko Horinouchi; Mikio Hidaka; Yoshiki Hirano; Haruhiko Kohyama, all of Hyogo, Japan

[73] Assignee: Mitsubishi Denki Kabushiki Kaisha, Tokyo, Japan

[21] Appl. No.: 94,876

[22] Filed: Jul. 22, 1993

[30] Foreign Application Priority Data

Aug. 1, 1992 [JP] Japan ..... 4-225022

[51] Int. Cl.[6] ..... H01H 33/18

[52] U.S. Cl. ..... 218/57; 218/30; 218/65; 218/63

[58] Field of Search ..... 200/144 R, 147 R, 200/147 A, 147 B, 148 R, 148 A, 148 B, 148 G, 144 A; 218/22, 23, 26, 27, 30, 43, 46, 48, 49, 50, 53, 54, 57, 59, 60–65, 68, 72, 73, 74

[56] References Cited

U.S. PATENT DOCUMENTS

| | | | |
|---|---|---|---|
| 3,670,126 | 6/1972 | Roidt | 200/148 R |
| 4,032,736 | 6/1977 | Ruffieux et al. | 200/147 R |
| 4,052,577 | 10/1977 | Votta | 200/147 R |
| 4,101,748 | 7/1978 | Meyer et al. | 200/148 A |
| 4,160,140 | 7/1979 | Rolff | 200/147 A |
| 4,409,447 | 10/1983 | Noeske | 200/148 A |
| 4,475,018 | 10/1984 | Arimoto et al. | 200/148 R |
| 4,658,108 | 4/1987 | Mauthe | 200/148 A |
| 4,697,055 | 9/1987 | Walter et al. | 200/148 B |
| 4,786,770 | 11/1988 | Hamano et al. | 200/147 R |

FOREIGN PATENT DOCUMENTS

| | | | |
|---|---|---|---|
| 0175954 | 4/1986 | European Pat. Off. | H01H 33/98 |
| 0248677 | 12/1987 | European Pat. Off. | H01H 33/98 |
| 2454688 | 11/1980 | France | H01H 33/91 |
| 2460537 | 1/1981 | France | H01H 33/91 |
| 2506511 | 11/1982 | France | H01H 73/18 |
| 2518798 | 6/1983 | France | H01H 33/91 |

OTHER PUBLICATIONS

H. Sasao e al., "Development of a Magnet–Assisted Autopuffer GCB", *IEEE 1990, 90 WM 158–6 PWRD,* pp. 1–7.

*Primary Examiner*—J. R. Scott
*Assistant Examiner*—Michael A. Friedhofer
*Attorney, Agent, or Firm*—Burns, Doane, Swecker & Mathis

[57] ABSTRACT

A switch for use in electric power includes a fixed contact, a moving contact performing a switching operation with respect to the fixed contact, a cylinder working with the moving contact, a piston slidably provided in the cylinder, a buffer chamber which is surrounded by the cylinder and the piston, and is filled with an arc-extinguishing gas, and a second insulating nozzle mounted to an end of the cylinder on the side of the fixed contact, wherein the arc-extinguishing gas in the buffer chamber is sprayed through the nozzle on an arc generating between the fixed contact and the moving contact at an opening time of the moving contact.

17 Claims, 9 Drawing Sheets

SWITCH

BACKGROUND OF THE INVENTION

1. Field of the Invention

The present invention relates to a switch for use in electric power, and in particular to a switch which can extinguish an arc generating at an opening time of a contact by using a buffer apparatus to spray an arc-extinguishing gas.

2. Description of the Prior Art

FIG. 1 is a side sectional view showing a state in the course of opening of a conventional switch disclosed in Japanese Utility Model Application Laid-Open No. 59-77741. In FIG. 1, reference numeral 1 means an upper terminal, 2 means a fixed contact attached to the upper terminal 1, 3 is a moving contact which is slid with respect to the fixed contact 2 to make and break contact therewith, 4 is an outer cylinder whose one end is secured to the upper terminal 1, and 5 is a first insulating nozzle secured to one end of the outer cylinder 4, and having a through-hole into which the moving contact is insertable at a closing time. Further, reference numeral 6 means a lower terminal, 7 means a holder formed in the fixed contact 2, 8 is a first permanent magnet mounted to the holder 7, 9 is a pressure accumulator which is surrounded by the upper terminal 1, the outer cylinder 4, and the insulating nozzle 5, and 10 is an arc generating when the moving contact 3 is opened apart from the fixed contact 2.

A description will now be given of the operation. When case current flows from the upper terminal 1 to the fixed contact 2, and to the moving contact 3 in an ON state of the switch, the moving contact 3 is driven in a direction of the arrow A by a drive mechanism (not shown). Accordingly, the fixed contact 2 and the moving contact 3 are opened apart from one another to generate the arc 10 between the contacts. A gas in the pressure accumulator 9 is heated by the arc 10 when a current phase is in a vicinity of a current peak, and pressure in the pressure accumulator increases due to expansion of the gas and molecular decomposition. Further, when the current phase is in a vicinity of a current zero point, a column diameter of the arc 10 becomes thinner, and a temperature thereof decreases. As a result, the gas is inversely sprayed on the arc 10 from the pressure accumulator 9 to extinguish the arc in the vicinity of the current zero point.

However, if the arc current has a small effective value, the arc energy is small. Consequently, a rise of gas pressure in the pressure accumulator 9 is reduced so that a force to spray the gas on the arc 10 becomes weak, resulting in a reduced arc-extinguishing performance. Hence, in the prior art switch, the annular magnet 8 is polarized in a direction of magnetic flux ($\phi$) as shown in FIG. 1, and is mounted in the holder 7 so as to generate a magnetic field having radial components in a vicinity of a distal end of the fixed contact 2. The arc 10 in the vicinity of the distal end of the fixed contact 2 is stretched in the pressure accumulator 9 while being driven in a direction of the Lorentz's force (i.e., in a circumferential direction) by the magnetic field having the radial components. Therefore, the gas in the pressure accumulator 9 is efficiently heated by the magnetically impelled arc 10 so that the rise of pressure in the pressure accumulator 9 increases, and the force to spray the gas on the arc 10 increases when the current phase is in the vicinity of the current zero point. Further, the arc 10 is driven to rotate so as to add a relative gas stream between the gas in the pressure accumulator 9 and the arc 10, resulting in an excellent arc-extinguishing performance even if cutoff current is small.

In the prior art switch as set forth above, the pressure accumulator is heated by the arc to increase the pressure thereof, and the arc-extinguishing gas therein flows out of the pressure accumulator in cutoff process. Accordingly, the mass of the arc-extinguishing gas in the pressure accumulator decreases, and the arc-extinguishing gas in the pressure accumulator is heated by the arc so as to gradually become a hot and lower density gas. As a result, there is a problem in that an insulation recovering characteristic is reduced after the current is cutoff.

SUMMARY OF THE INVENTION

In view of the foregoing, it is an object of the present invention to provide a switch having an excellent insulation recovering characteristic after current cutoff.

It is another object of the present invention to provide a switch having an excellent cutoff performance.

It is a further object of the present invention to provide a switch having an excellent operability.

According to the first aspect of the present invention, for achieving the above-mentioned objects, there is provided a switch including a fixed contact, a moving contact performing a switching operation with respect to the fixed contact, a cylinder working with the moving contact, a piston slidably provided in the cylinder, a buffer chamber which is surrounded by the cylinder and the piston, and is filled with an arc-extinguishing gas, and a second insulating nozzle mounted to an end of the cylinder on the side of the fixed contact, wherein the arc-extinguishing gas in the buffer chamber is sprayed through the nozzle on the arc generating between the fixed contact and the moving contact at an opening time of the moving contact.

Consequently, in the switch according to the first aspect of the present invention, the arc-extinguishing gas in the buffer chamber is sprayed through the nozzle on the arc generating between the fixed contact and the moving contact at the opening time of the moving contact. As a result, it is possible to improve an insulation recovering characteristic after the current cutoff.

According to the second aspect of the present invention, there is provided a switch including an outer cylinder mounted to an outer periphery of a fixed contact, a first insulating nozzle mounted to an end of the outer cylinder on the side of a moving contact, into which the moving contact is slidably inserted, and a pressure accumulator which is surrounded by the outer cylinder and the first insulating nozzle, and is filled with an arc-extinguishing gas.

Consequently, the switch according to the second aspect of the present invention includes the pressure accumulator which is surrounded by the outer cylinder and the first insulating nozzle, and is filled with the arc-extinguishing gas. As a result, it is possible to improve a cutoff performance as well as an insulation recovering characteristic after current cutoff.

According to the third aspect of the present invention, there is provided a switch in which a rod-like or annular first permanent magnet is provided in a fixed contact or on an outer periphery of the fixed contact, the first permanent magnet establishing a magnetic field to drive an arc between the fixed contact and a moving contact at an opening time.

Consequently, in the switch according to the third aspect of the present invention, the first permanent magnet is provided for the fixed contact so that the first permanent magnet establishes the magnetic field to drive the arc between the fixed contact and the moving contact at the opening time. As a result, it is possible to further improve a cutoff performance.

According to the fourth aspect of the present invention, there is provided a switch in which a second nozzle extends ahead of a distal end of the moving contact, and a fixed contact is slidably inserted into the second nozzle at a closing time of the moving contact.

Consequently, in the switch according to the fourth aspect of the present invention, the second nozzle extends ahead of the distal end of the moving contact, and the fixed contact is slidably inserted into the second nozzle at the closing time of the moving contact. As a result, it is possible to eliminate an outer cylinder and a first insulating nozzle, and avoid residence of an arc-extinguishing gas from a buffer chamber.

According to the fifth aspect of the present invention, there is provided a switch in which an end surface of a first permanent magnet opposed to a moving contact extends on the side of the moving contact, or a magnetic material being disposed to extend from the end surface on the side of the moving contact.

Consequently, in the switch according to the fifth aspect of the present invention, the end surface of the first permanent magnet opposed to the moving contact extends on the side of the moving contact, or the magnetic material is disposed to extend from the end surface on the side of the moving contact. As a result, it is possible to enhance a radial magnetic flux density in a vicinity of a distal end of a fixed contact, and provide an excellent cutoff performance, and an excellent insulation recovering performance.

According to the sixth aspect of the present invention, there is provided a switch in which a first permanent magnet is enclosed with an insulator.

Consequently, in the switch according to the sixth aspect of the present invention, the first permanent magnet is enclosed with the insulator to enable arc heat protection and mechanical impact protection at an opening time. Therefore, it is possible to reduce damage to the first permanent magnet, and maintain an intensive radial magnetic flux density in a vicinity of a distal end of a fixed contact, resulting in excellent cutoff performance and excellent insulation recovering performance.

According to the seventh aspect of the present invention, there is provided a switch including an annular or annularly disposed second magnet in a second insulating nozzle or on an outer periphery of the second insulating nozzle.

Consequently, the switch according to the seventh aspect of the present invention includes the second permanent magnet mounted to the second insulating nozzle. Therefore, a magnetic field in a vicinity of a distal end of a fixed contact can be enhanced, and another magnetic field in a vicinity of a distal end of a moving contact is also generated to increase a driving force of an arc. As a result, it is possible to provide excellent cutoff performance, and excellent insulation recovering characteristic.

According to the eighth aspect of the present invention, there is provided a switch including an electric field relaxing fixed shield formed about a fixed contact, an electric field relaxing moving shield formed about a moving contact so as to work with the moving contact, and an annular or annularly disposed third permanent magnet in the fixed shield.

Consequently, the switch according to the eighth aspect of the present invention includes the electric field relaxing fixed shield formed about the fixed contact, the electric field relaxing moving shield formed about the moving contact so as to work with the moving contact, and the annular or annularly disposed third permanent magnet in the fixed shield. Therefore, a magnetic filed in a vicinity of a distal end of the fixed contact is enhanced by the third permanent magnet, and another magnetic field in a vicinity of a distal end of the moving contact is also generated. As a result, it is possible to provide excellent cutoff performance, and an excellent insulation recovering characteristic.

According to the ninth aspect of the present invention, there is provided a switch in which a fixed shield is provided with a first gas outlet through which an arc-extinguishing gas in a vicinity of a fixed contact can flow out of the fixed shield.

Consequently, in the switch according to the ninth aspect of the present invention, the fixed shield is provided with the first gas outlet through which the arc-extinguishing gas in the vicinity of the fixed contact can flow out of the fixed shield. Therefore, the arc-extinguishing gas can flow out of a buffer chamber through the outlet so that there is no stagnation of hot gas heated by the arc in the vicinity of a distal end of the fixed contact, resulting in an improved insulation recovering characteristic.

According to the tenth aspect of the present invention, there is provided a switch in which a cylinder is provided with a second gas outlet through which an arc-extinguishing gas in a buffer chamber can flow out of the cylinder immediately after an opening operation is started.

Consequently, in the switch according to the tenth aspect of the present invention, the cylinder is provided with the second gas outlet through which the arc-extinguishing gas in the buffer chamber can flow out of the cylinder immediately after the opening operation is started. As a result, it is possible to reduce a rise of pressure in the buffer chamber for a cutoff reserve period immediately after the opening operation is started, and reduce an operating force of a moving portion without reduction of an insulation recovering characteristic.

According to the eleventh aspect of the present invention, there is provided a switch including an insulating cover to cover a distal end of a fixed shield.

Consequently, the switch according to the eleventh aspect of the present invention includes the insulating cover to cover the distal end of the fixed shield. Therefore, a leg of an arc is never transferred to the fixed shield even if the arc is magnetically impelled to radially extend. As a result, it is possible to obtain a stable insulation recovering performance after current cutoff.

The above and further objects and novel features of the invention will more fully appear from the following detailed description when the same is read in connection with the accompanying drawing. It is to be expressly understood, however, that the drawings are for purpose of illustration only and are not intended as a definition of the limits of the invention.

DETAILED DESCRIPTION OF THE PREFERRED EMBODIMENTS

Preferred embodiments of the invention will now be described in detail referring to the accompanying drawings.

Embodiment 1

Figure 1:
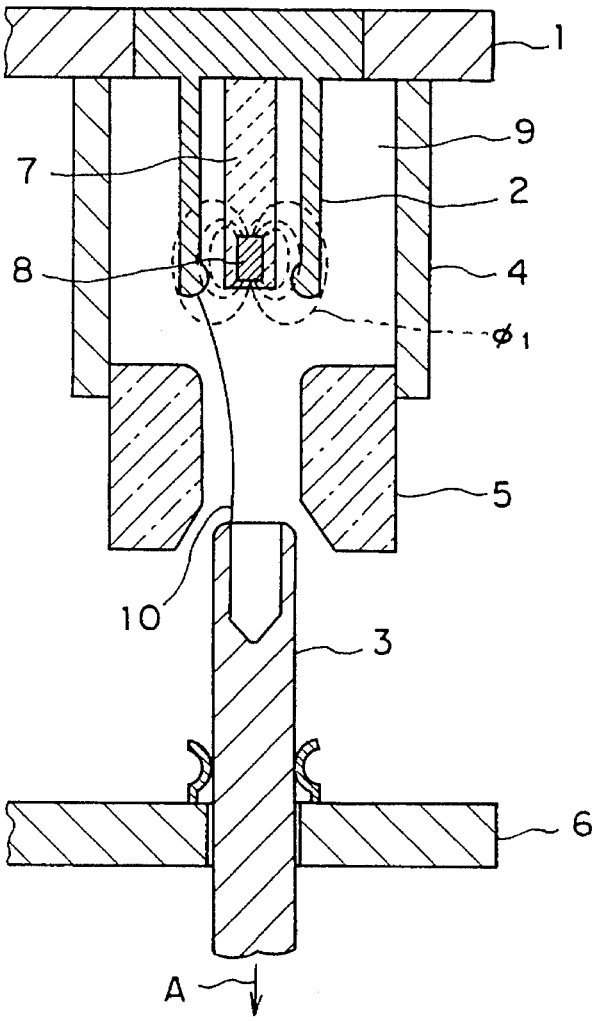
FIG. 1 (PRIOR ART)
FIG. 1 is a side sectional view showing a state in the course of a cutoff operation of a conventional switch.
Figure 2:
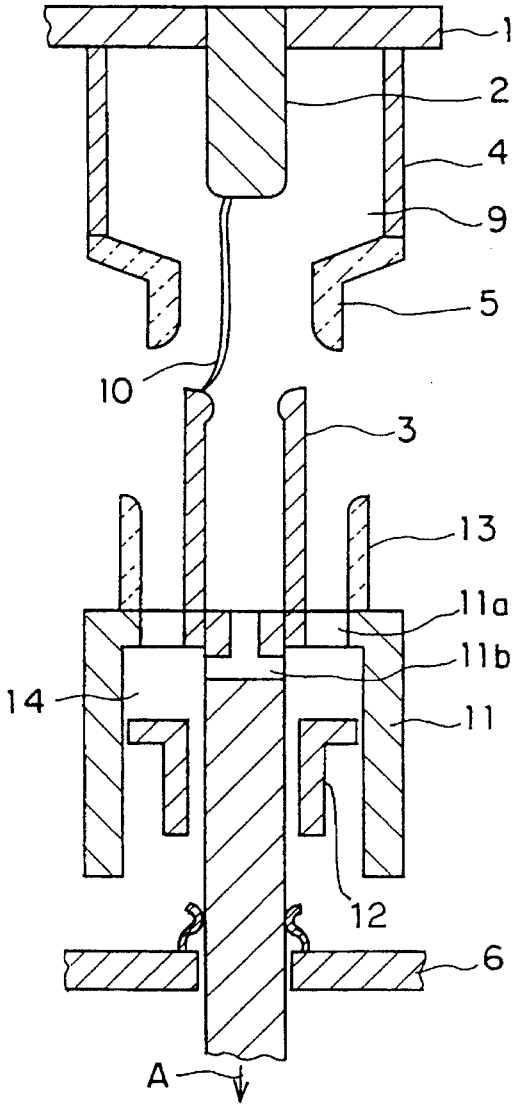
FIG. 2 is a side sectional view showing a state in the course of opening of a switch according to one embodiment in the first aspect and the second aspect of the present invention.

FIG. 2 is a side sectional view showing a state in the course of opening of a switch according to one embodiment in the first aspect and the second aspect of the present invention. In FIG. 2, though component parts identified by reference numerals 1 to 6, 9 to 10 are identical with those shown in FIG. 1, the prior art switch in the embodiment is not provided with a first permanent magnet 8. In FIG. 2, reference numeral 11 means a cylinder working with the moving contact 3, 12 means a piston which is provided in the cylinder 11, and is slidably fixed independent of the cylinder, 13 is a heat-resistant second insulating nozzle mounted to an end of the cylinder 11 on the side of the fixed contact 2, and 14 is a buffer chamber surrounded by the cylinder 11 and the piston 12. Further, reference numerals 11*a*, 11*b* are first and second outlets provided in the cylinder 11, through which an arc-extinguishing gas in the buffer chamber externally flows.

A description will now be given of the operation. In FIG. 2, an arc 10 is generated between the contacts 2 and 3 after opening. A gas in the pressure accumulator 9 is heated by the arc 10 when a current phase is in a vicinity of a current peak, and pressure in the pressure accumulator 9 increases due to expansion of the gas and molecular decomposition. Further, when the current phase is in a vicinity of a current zero point, a column diameter of the arc 10 becomes thinner, and a temperature thereof decreases. As a result, the gas is inversely sprayed on the arc 10 from the pressure accumulator 9 when the current phase is in the vicinity of the current zero point, resulting in extension of the arc.

On the other hand, in a cutoff process, the cylinder 11 moves together with the moving contact 3 in a direction shown by the arrow (A) so as to increase pressure of the buffer chamber 14, and discharge the arc-extinguishing gas of the buffer chamber 14 through the first outlet 11*a* or the second outlet 11*b*. Accordingly, the arc-extinguishing gas is sprayed on the arc through the second insulating nozzle 13 or the moving contact 3. It is thereby possible to enhance a cutoff performance, and enhance, in particular, an insulation recovering characteristic after current cutoff.

Though both the first outlet 11*a* and the second outlet 11*b* may be provided as a gas outlet, it must be noted that the insulation recovering characteristic should not be reduced by providing only one of the outlets.

Embodiment 2

Figure 3:
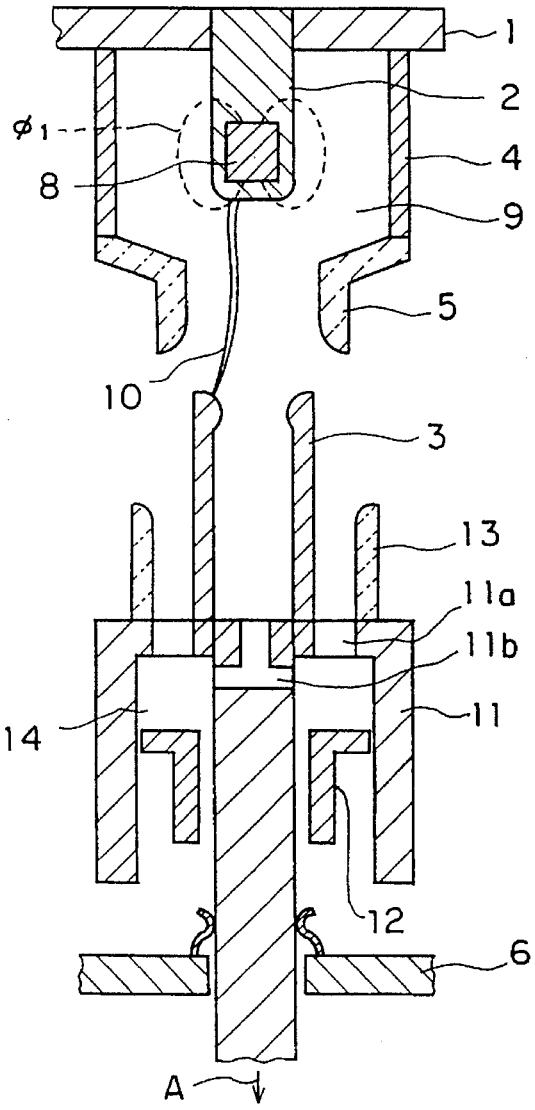
FIG. 3 is a side sectional view showing a state in the course of opening of a switch according to one embodiment in the third aspect of the present invention.

FIG. 3 is a side sectional view showing a state in the course of opening of a switch according to one embodiment in the third aspect of the present invention. In FIG. 3, a rod-like fixed contact 2 is provided with, for example, a columnar or annular first permanent magnet 8.

A description will now be given of the operation. In FIG. 3, the first permanent magnet 8 is polarized in a direction of a line of magnetic force (ϕ1), and is provided in the fixed contact 2 to be close to a distal end thereof. Therefore, it is possible to provide an intensive radial magnetic field in a vicinity of the distal end of the fixed contact 2. Hence, an arc 10 generates after the contacts 2 and 3 are opened, and is stretched while being circumferentially driven at a high speed by the Lorentz's force. As a result, the arc-extinguishing gas in the pressure accumulator 9 can be efficiently heated, and a rise of inner pressure thereof can be promoted.

A leg of the arc extending from the distal end of the fixed contact 2 is rotated by the radial magnetic field so as not to stay at one position. Therefore, a rise of temperature of the fixed contact 2 is reduced so that metallic vapor of the fixed contact 2 can be reduced, resulting in an improved insulation recovering characteristic.

As a result, it is possible to provide an excellent cutoff performance as well as the same effect as that in the embodiment 1, because of the gas sprayed on the arc 10 when the current phase is in the vicinity of the current zero point, and a relative gas stream between the gas and the arc 10, which is obtained by the arc 10 rotationally impelled by the magnetic field.

Embodiment 3

Figure 4:
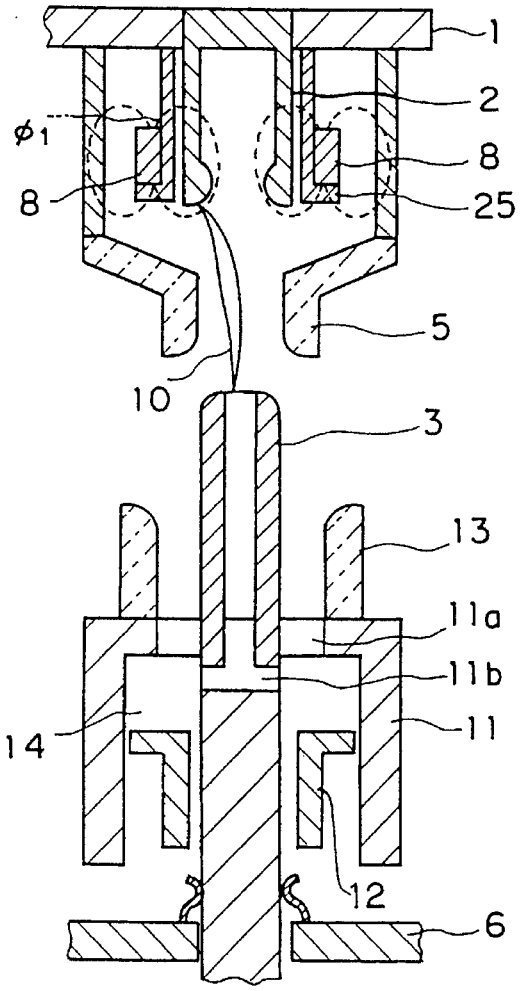
FIG. 4 is a side sectional view showing a state in the course of opening of a switch according to another embodiment in the third aspect of the present invention.

FIG. 4 is a side sectional view showing a state in the course of opening of a switch according to another embodiment in the third aspect of the present invention. In FIG. 4, reference numeral 25 means a magnet holder mounted on an outer periphery of a fixed contact 2, and an annular or annularly disposed permanent magnet 8 is mounted on an outer periphery of the magnet holder so as to enlarge a shape of the first permanent magnet 8. Therefore, an intensive radial magnetic field is generated in a vicinity of a distal end of the fixed contact 2 so that an arc 10 generating after the contacts 2 and 3 are opened can be stretched while being circumferentially driven at a high speed.

Embodiment 4

Figure 5:
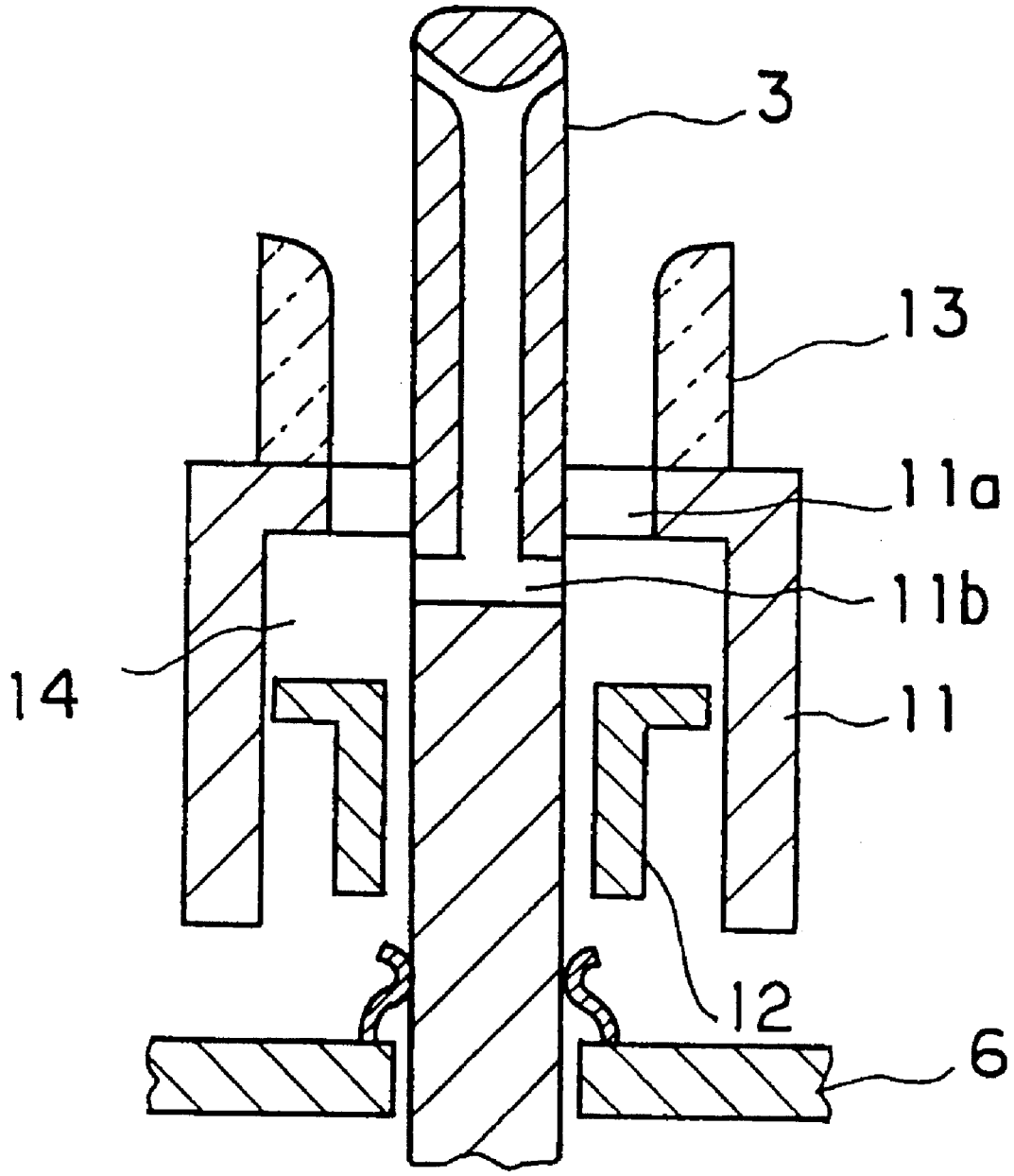
FIG. 5 is a side sectional view showing a moving portion of a switch according to still another embodiment in the third aspect of the present invention.

FIG. 5 is a side sectional view showing a moving portion of a switch according to still another embodiment in the third aspect of the present invention. It is possible to effectively spray the arc-extinguishing gas on the arc extending from an outer periphery in a vicinity of a distal end of a moving contact by providing at least one exit of the outlet 11b in the outer periphery of the moving contact 3 in the vicinity of the distal end of the moving contact 3.

Embodiment 5

Figure 6:
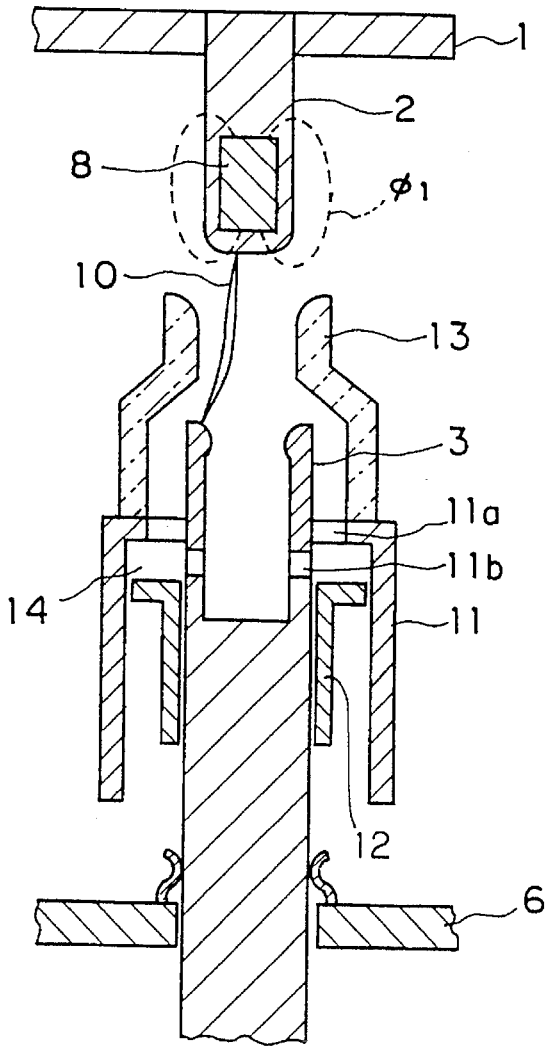
FIG. 6 is a side sectional view showing a state in the course of opening of a switch according to one embodiment in the fourth aspect of the present invention.

FIG. 6 is a side sectional view showing a state in the course of opening of a switch according to one embodiment in the fourth aspect of the present invention. In the embodiment, the outer cylinder 4 and the first insulating nozzle 5 shown in FIG. 2 are omitted, the second insulating nozzle 13 extends ahead of a distal end of the moving contact 3, and the fixed contact 2 is slidably inserted into the second insulating nozzle 13 at a closing time. In the embodiment shown in FIG. 6, the fixed contact 2 is not circumferentially surrounded by the pressure accumulator 9 (see FIG. 2) so that no arc-extinguishing gas is sprayed by accumulated pressure of the gas. However, the arc is rotationally impelled by the permanent magnet 8, and a gas stream flows through the second insulating nozzle 13 because of compression in a buffer chamber 14, resulting in the same effect as that in the embodiment 1. Further, the arc-extinguishing gas from the buffer chamber 14 can smoothly flow in the vicinity of the fixed contact 2 without stagnation. As a result, it is also possible to provide the same effect as that in the embodiment 2.

Embodiment 6

Figure 7:
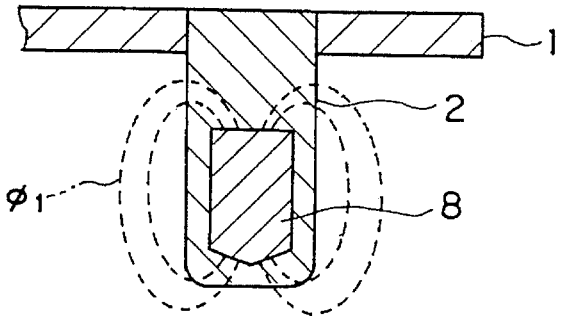
FIG. 7 is a side sectional view showing a fixed portion of a switch according to one embodiment in the fifth aspect of the present invention.

FIG. 7 is a side sectional view showing a fixed portion of a switch according to one embodiment in the fifth aspect of the present invention. In FIG. 7, an end of a first permanent magnet 8 opposed to a moving contact is tapered or curved to extend on the side of the moving contact so as to enhance radial magnetic flux density in a vicinity of a fixed contact 2.

Embodiment 7

Figure 8:
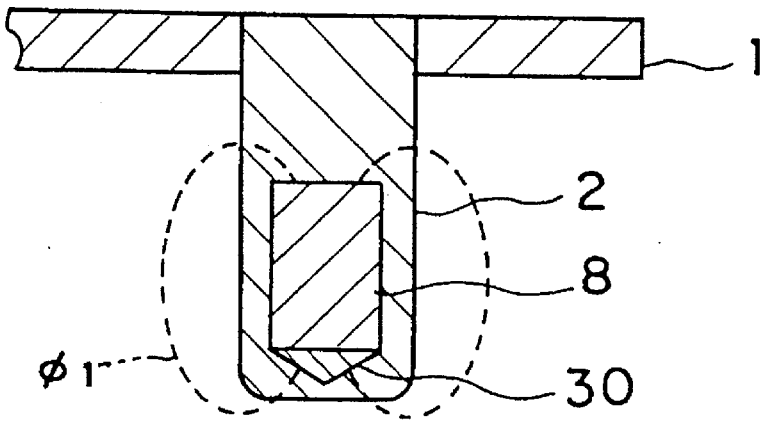
FIG. 8 is a side sectional view showing a fixed portion of a switch according to another embodiment in the fifth aspect of the present invention.

FIG. 8 is a side sectional view showing a fixed portion of a switch according to another embodiment in the fifth aspect of the present invention. In FIG. 8, reference numeral 30 means a magnetic material mounted to an end surface of a first permanent magnet 8 opposed to a moving contact. The magnetic material 30 is tapered or curved to extend on the side of the moving contact so as to enhance radial magnetic flux density in a vicinity of a fixed contact 2.

Embodiment 8

Figure 9:
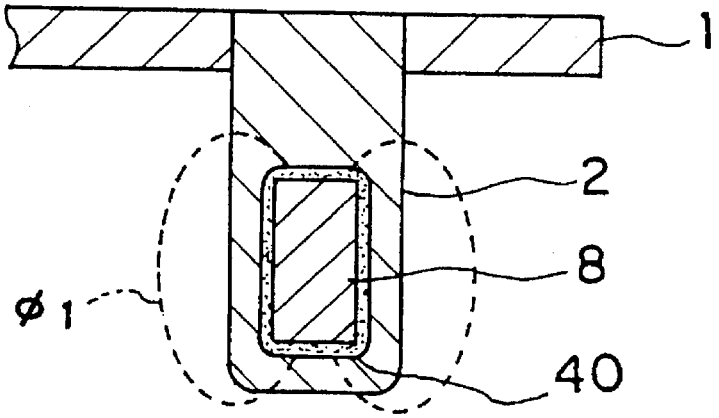
FIG. 9 is a side sectional view showing a fixed portion of a switch according to one embodiment in the sixth aspect of the present invention.

FIG. 9 is a side sectional view showing a fixed portion of a switch according to one embodiment in the sixth aspect of the present invention. In FIG. 9, reference numeral 40 means an insulator, that is, a mag-cover with which a first permanent magnet 8 is circumferentially enclosed. The first permanent magnet 8 is enclosed with the insulator 40 to enable arc heat protection and mechanical impact protection so as to reduce damage to the first permanent magnet 8, and maintain enhanced radial magnetic flux density in a vicinity of a fixed contact 2.

Embodiment 9

Figure 10:
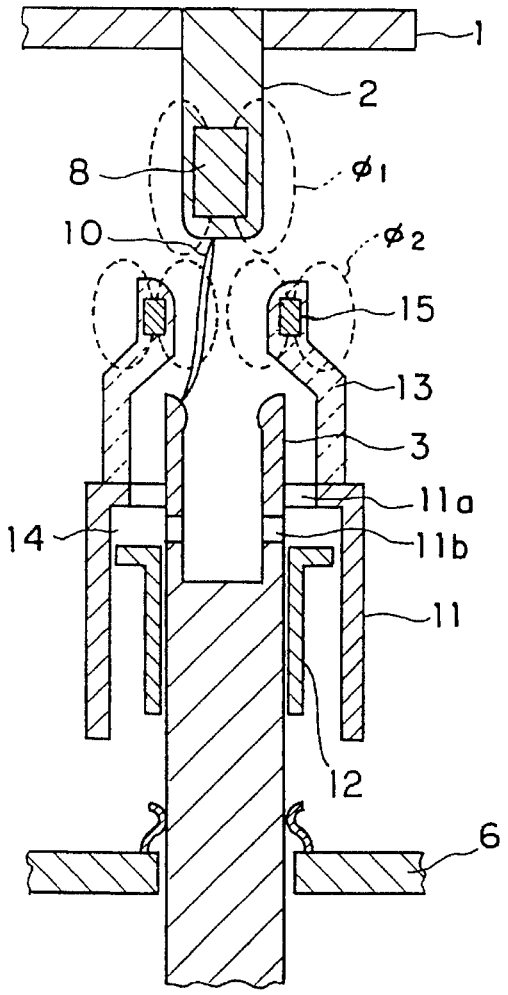
FIG. 10 is a side sectional view showing a state in the course of opening of a switch according to one embodiment in the seventh aspect of the present invention.

FIG. 10 is a side sectional view showing a state in the course of opening of a switch according to one embodiment in the seventh aspect of the present invention. In FIG. 10, a second permanent magnet 15 is provided in a second insulating nozzle 13 extending from a distal end of a moving contact 3 shown in FIG. 6. In FIG. 10, there are the first permanent magnet 8 and the second permanent magnet 15 so as to enhance a magnetic field in a vicinity of a distal end of a fixed contact 2, and generate another magnetic field in a vicinity of the distal end of the moving contact 3. As a result, it is possible to further increase a driving force of an arc, and improve a cutoff performance.

In this case, the first permanent magnet 8 and the second permanent magnet 15 are polarized so as to generate magnetic flux $\phi 1$ and magnetic flux $\phi 2$, respectively. A magnetic field between the permanent magnets 8 and 15 may be polarized in either direction to enhance an axial component magnetic field or direction to enhance a radial component magnetic field. However, the direction to enhance the radial component magnetic field is more effective than the direction to enhance the axial component magnetic field since the arc can be further rotationally impelled in the direction to enhance the radial component magnetic field.

Embodiment 10

Figure 11:
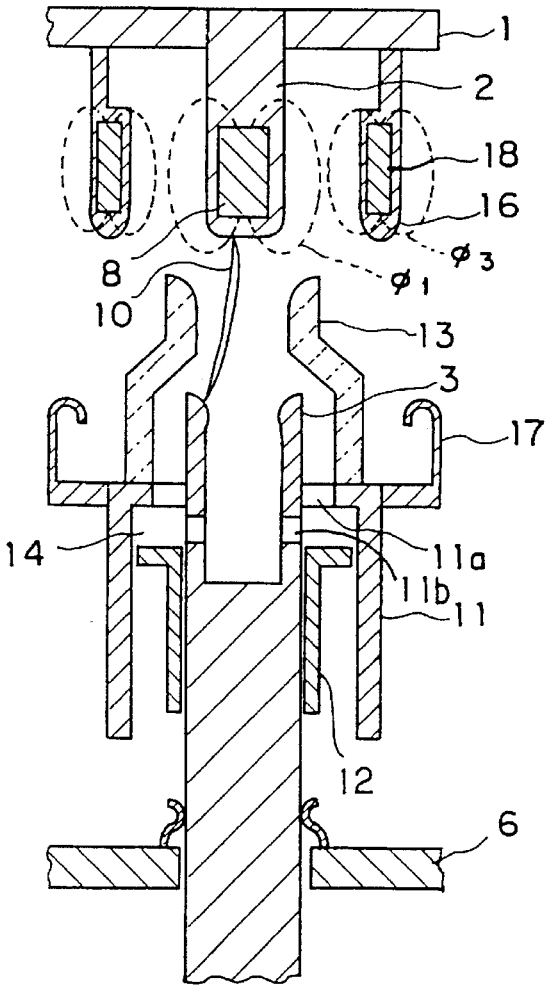
FIG. 11 is a side sectional view showing a state in the course of opening of a switch according to one embodiment in the eighth aspect of the present invention.

FIG. 11 is a side sectional view showing a state in the course of opening of a switch according to one embodiment in the eighth aspect of the present invention. In FIG. 11, reference numeral 16 means a metallic electric field relaxing fixed shield formed about a fixed contact 2, 17 means a metallic electric field relaxing moving shield formed about a moving contact 3, and 18 is a third permanent magnet provided in the fixed shield 16. In high voltage switches, the fixed shield 16 and the moving shield 17 are used to improve dielectric strength between the fixed contact 2 and the moving contact 3 after current cutoff. There are the first permanent magnet 8 and the third permanent magnet 18 to enhance a magnetic field in a vicinity of a distal end of the fixed contact 2, and generate another magnetic field in a vicinity of a distal end of the moving contact 3. As a result, it is possible to increase a driving force of an arc so as to further improve a cutoff performance.

In this case, the third permanent magnet 18 is polarized so as to generate magnetic flux $\phi 3$. A resultant magnetic field of the first and the third permanent magnets 8 and 18 may be polarized in either direction to enhance an axial component magnetic field or direction to enhance a radial component magnetic field. However, the direction enhance the radial component magnetic field is more effective than the direction to enhance the axial component magnetic field since the arc can be further rotationally impelled in the direction enhance the radial component magnetic filed.

Embodiment 11

Figure 12:
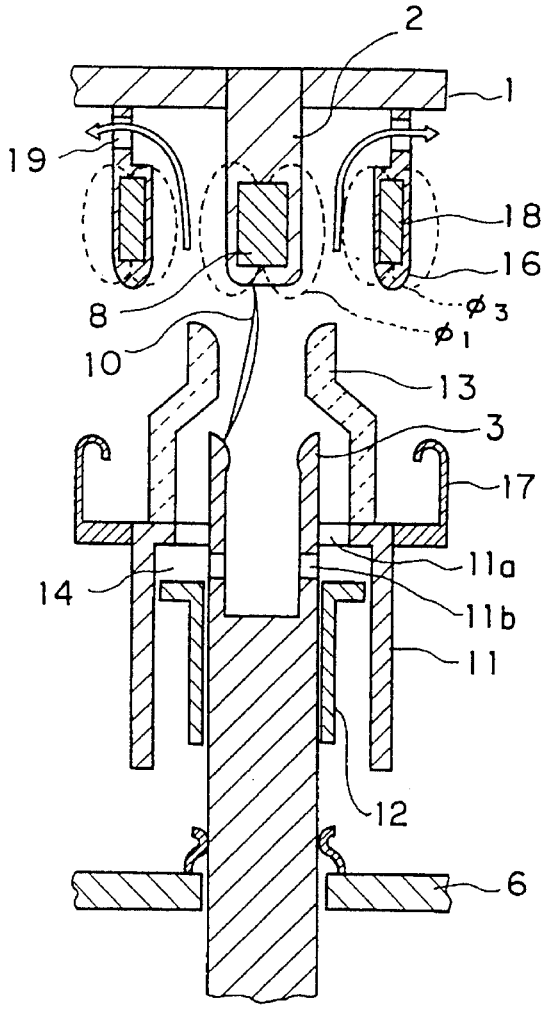
FIG. 12 is a side sectional view showing a state in the course of opening of a switch according to one embodiment in the ninth aspect of the present invention.

FIG. 12 is a side sectional view showing a state in the course of opening of a switch according to one embodiment in the ninth aspect of the present invention. In FIG. 12, reference numeral 19 means at least one first gas outlet which is provided in a fixed shield 16. Without the gas outlet 19, an arc-extinguishing gas of a buffer chamber 14 having increased pressure flows through a second insulating nozzle 13 in a cutoff process. Accordingly, hot gas may stagnate in a vicinity of a distal end of a fixed contact 2 since the arc-extinguishing gas sprayed on an arc 10 is prevented by the fixed shield 16 from flowing. This causes reduction of an insulation recovering performance after current cutoff. However, if the first gas outlet 19 is provided, the arc-extinguishing gas can flow through the first gas outlet 19 from the buffer chamber 14 as shown by the arrow in FIG. 12. Hence, there is no stagnation of the hot gas heated by the arc 10 in the vicinity of the distal end of the fixed contact 2, resulting in an improved insulation recovering characteristic.

In this case, there is provided at least one hole-like or groove-like first outlet 19, and the first outlet may be provided in any desired form which can reduce fluid resistance of the flowing arc-extinguishing gas.

Embodiment 12

Figure 13:
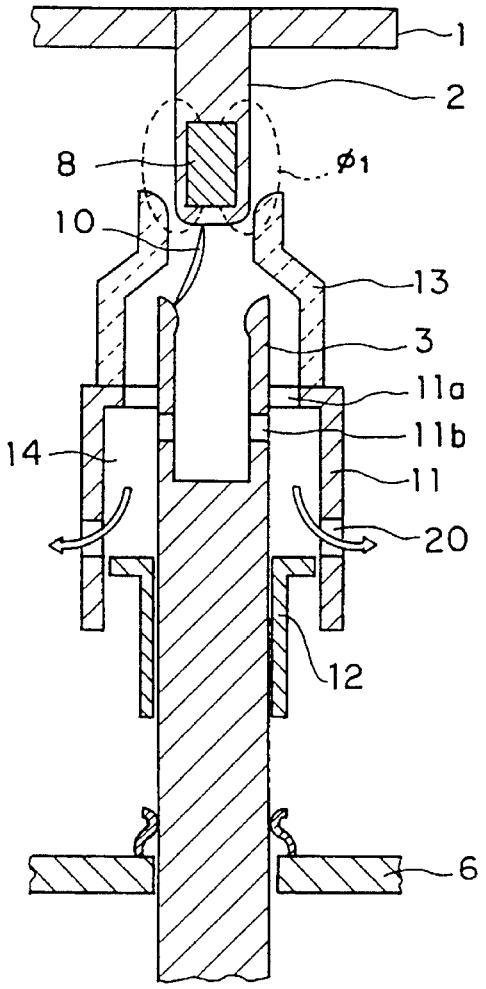
FIG. 13 is a side sectional view showing a state immediately after opening of a switch according to one embodiment in the tenth aspect of the present invention.
Figure 14:
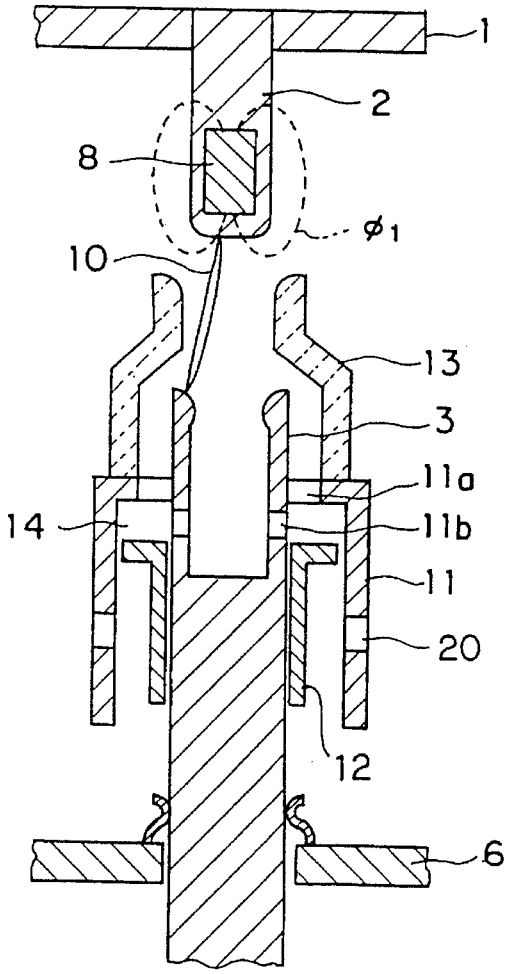
FIG. 14 is a side sectional view showing a state in the course of cutoff of a switch according to one embodiment in the tenth aspect of the present invention.

FIGS. 13 and 14 are side sectional views of a switch according to one embodiment in the tenth aspect of the present invention. FIG. 13 shows a state immediately after opening of the switch, and FIG. 14 shows a state in the course of cutoff of the switch. In FIGS. 13 and 14, reference numeral 20 means a second gas outlet provided in a cylinder 11. The second gas outlet 20 is communicated with a buffer chamber 14 immediately after an opening operation is started, that is, for a period from the start of opening to a time when a distal end of a second insulating nozzle 13 is separated from a distal end of a fixed contact 2 (hereinafter referred to as cutoff reserve period). Further, the second gas outlet 20 is closed by a valve action of a piston 12 in an opening process at the separation time point or later.

In the switch as shown in FIGS. 13 and 14, the current cutoff is typically performed after the distal end of the second insulating nozzle 13 is separated from the distal end of the fixed contact 2. Therefore, an arc-extinguishing gas stream may be generated from the buffer chamber 14 at the separation time point or later. In the cutoff process, pressure of the buffer chamber 14 increases as the cylinder 11 moves, and the arc-extinguishing gas of the buffer chamber 14 externally flows through the second gas outlet 20 as shown by the arrow for the cutoff reserve period. Thus, a rise of the pressure in the buffer chamber 14 can be reduced (see FIG. 13). After the cutoff reserve period, the further advanced opening causes the arc-extinguishing gas of the buffer chamber 14 to flow through exclusively the insulating nozzle 13, and to be sprayed on an arc 10, resulting in the cutoff (see FIG. 14).

It is possible to provide the same effect as that in the embodiment 1, and further reduce the rise of the pressure in the buffer chamber for the cutoff reserve period by providing the second outlet 20 in the cylinder 11 as set forth above. As a result, an operating force of a moving portion can be reduced without reduction of an insulation recovering characteristic.

In this case, there is provided at least one hole-like or groove-like first outlet 20, and the first outlet 20 may be provided in any desired form which can reduce fluid resistance of the flowing arc-extinguishing gas.

Figure 15:
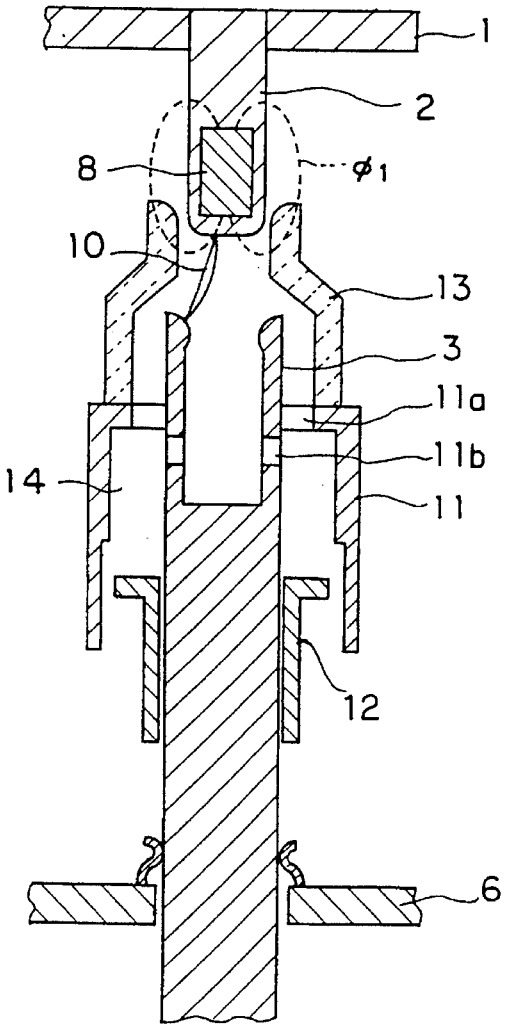
FIG. 15 is a side sectional view showing a state immediately after opening of a switch according to another embodiment in the tenth aspect of the present invention.

Alternatively, as shown in FIG. 15, an inner sectional area of the cylinder 11 may be varied to form the second gas outlet 20 so as to provide the same effect.

Embodiment 13

Figure 16:
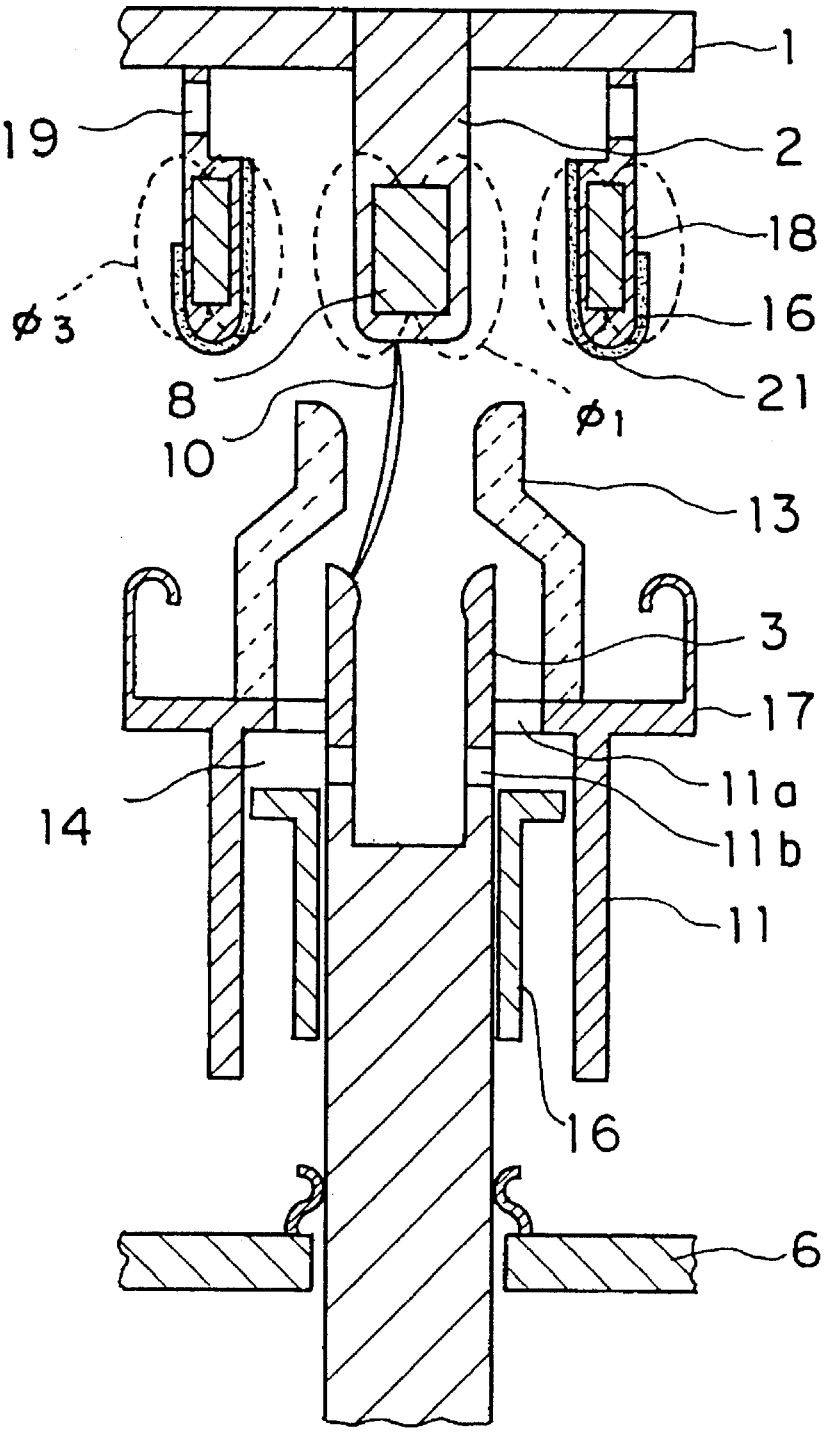
FIG. 16 is a side sectional view showing a state in the course of opening of a switch according to one embodiment in the eleventh aspect of the present invention.

FIG. 16 is a side sectional view showing a state in the course of opening of a switch according to one embodiment in the eleventh aspect of the present invention. In FIG. 16, reference numeral 21 means an insulating cover to cover a distal end of a fixed shield 16. An arc 10 is generated between a fixed contact 2 and a moving contact 3 in a cutoff process, and is rotationally impelled by a magnetic field caused by a first permanent magnet 8 or a third permanent magnet 18 while a rotational radius of the arc 10 gradually extends. When a positive column portion of the arc 10 is in closer to or contacts the fixed shield 16, a leg of the arc positioned at a distal end of the fixed contact 2 is transferred to a distal end of the fixed shield 16. At this time, an arc may be generated between the fixed shield 16 and the moving contact 3. In such a condition, an arc-extinguishing gas stream from a buffer chamber 14 can not reach the distal end of the fixed shield 16 due to a constricted form of the second insulating nozzle 13 serving as the outlet for the arc-extinguishing gas. Therefore, hot gas heated by the arc 10 stagnates in a vicinity of the distal end of the fixed shield 16. As a result, an insulation recovering characteristic after current cutoff may be reduced.

Thus, the distal end of the fixed shield 16 is covered with the insulating cover 21 as shown in FIG. 16. Thereby, the leg of the arc is not transferred to the fixed shield 16 even if the arc is magnetically impelled to radially extend. As a result, the arc-extinguishing gas from the buffer chamber 14 can be efficiently sprayed on the arc 10 so as to provide a stable insulation recovering performance after current cutoff.

The first permanent magnet 8 is made of ferromagnetic material such as ferrite-base material, alnico-base material, or rare earth material. Further, divided magnets may be annularly disposed as the first permanent magnet 8. In addition, the first, second, and third permanent magnets 8, 15, 18 may be separately employed, and it must be noted that the same effect can be provided by combining a plurality of the permanent magnets.

Since the present invention can tremendously improve the insulation recovering characteristic after the current cutoff, the invention may be applied to a resistance contact in a resistance cutoff mode for use in high voltage class.

As set forth above, according to the first aspect of the present invention, the switch includes the fixed contact, the moving contact performing the switching operation with respect to the fixed contact, the cylinder working with the moving contact, the piston slidably provided in the cylinder, the buffer chamber which is surrounded by the cylinder and the piston, and is filled with the arc-extinguishing gas, and the second insulating nozzle mounted to the end of the cylinder on the side of the fixed contact, wherein the arc-extinguishing gas in the buffer chamber is sprayed through the nozzle on the arc generating between the fixed contact and the moving contact at the opening time of the moving contact. As a result, it is possible to improve the insulation recovering characteristic after the current cutoff.

According to the second aspect of the present invention, the switch includes the outer cylinder mounted to the outer periphery of the fixed contact, the first insulating nozzle mounted to the end of the outer cylinder on the side of the moving contact, into which the moving contact is slidably inserted, and the pressure accumulator which is surrounded by the outer cylinder and the first insulating nozzle, and is filled with the arc-extinguishing gas. As a result, it is possible to more next line improve the cutoff performance as well as the above effect.

According to the third aspect of the present invention, the rod-like or annular first permanent magnet is provided in the fixed contact or on the outer periphery of the fixed contact, and the first permanent magnet establishes the magnetic field to drive the arc between the fixed contact and the moving contact at the opening time. As a result, it is possible to further improve the cutoff performance.

According to the fourth aspect of the present invention, the second nozzle extends from the distal end of the moving contact, and the fixed contact is slidably inserted into the second nozzle at the closing time of the moving contact. As the result, it is possible to eliminate the outer cylinder and the first insulating nozzle, and avoid residence of the arc-extinguishing gas from the buffer chamber.

According to the fifth aspect of the present invention, the end surface of the first permanent magnet opposed to the moving contact extends on the side of the moving contact, or the magnetic material is disposed to extend from the end surface on the side of the moving contact. As the result, it is possible to enhance a radial magnetic flux density in the vicinity of the distal end of the fixed contact, and provide excellent cutoff performance, and excellent insulation recovering performance.

According to the sixth aspect of the present invention, the first permanent magnet is enclosed with the insulator to enable the arc heat protection and the mechanical protection at the opening time. Therefore, it is possible to reduce damage to the first permanent magnet, and maintain an intensive radial magnetic flux density in the vicinity of the distal end of the fixed contact, resulting in excellent cutoff performance and excellent insulation recovering performance.

According to the seventh aspect of the present invention, the switch includes the annular or annularly disposed second magnet in the second insulating nozzle or on the outer periphery of the second insulating nozzle. As a result, it is possible to provide excellent cutoff performance, and excellent insulation recovering characteristic.

According to the eighth aspect of the present invention, the switch includes the electric field relaxing fixed shield formed about the fixed contact, the electric field relaxing moving shield formed about the moving contact so as to work with the moving contact, and the annular or annularly disposed third permanent magnet in the fixed shield. Therefore, the magnetic field in the vicinity of the distal end of the fixed contact is enhanced by the third permanent magnet, and another magnetic field in the vicinity of the distal end of the moving contact is also generated. As a result, it is possible to provide excellent cutoff performance, and excellent insulation recovering characteristic.

According to the ninth aspect of the present invention, the fixed shield is provided with the first gas outlet through which the arc-extinguishing gas in the vicinity of the fixed contact can flow out of the fixed shield. Therefore, the arc-extinguishing gas can flow out of the buffer chamber through the outlet so that there is no stagnation of the hot gas heated by the arc in the vicinity of the distal end of the fixed contact, resulting in improved insulation recovering characteristic.

According to the tenth aspect of the present invention, the cylinder is provided with the second gas outlet through which the arc-extinguishing gas in the buffer chamber can flow out of the cylinder immediately after the start of the opening operation. As a result, it is possible to reduce the rise of pressure in the buffer chamber for the cutoff reserve period immediately after the start of the opening operation, and reduce the operating force of the moving portion without reduction of the insulation recovering characteristic.

According to the eleventh aspect of the present invention, the switch includes the insulating cover to cover the distal end of the fixed shield. Therefore, the leg of the arc is never transferred to the fixed shield even if the arc is magnetically impelled to radially extend. As the result, it is possible to a stable insulation recovering performance after the current cutoff.

While preferred embodiments of the invention have been described using specific terms, such description is for illustrative purposes only, and it is to be understood that changes and variations may be made without departing from the spirit or scope of the following claims.

What is claimed is:

1. A switch comprising:

a fixed contact;

a moving contact performing a switching operation with respect to said fixed contact;

a cylinder working with said moving contact;

a piston slidably provided in said cylinder;

a buffer chamber which is surrounded by said cylinder and said piston, and is filled with an arc-extinguishing gas;

a first insulating nozzle mounted to an end of said cylinder on the side of said fixed contact;

an outer cylinder mounted to surround an outer periphery of said fixed contact;

a second insulating nozzle mounted to an end of said outer cylinder on the side of said moving contact, into which said moving contact is slidably inserted; and a pressure accumulator which is surrounded by said outer cylinder and said second insulating nozzle, and is filled with said arc-extinguishing gas, wherein said arc-extinguishing gas in said buffer chamber is sprayed outwardly through said first insulating nozzle on an arc generating between said fixed contact and said moving contact at an opening time of said moving contact.

2. A switch according to claim 1, wherein a rod-like or annular first permanent magnet is provided in said fixed contact, and said first permanent magnet establishes a magnetic field to drive said arc generating between said fixed contact and said moving contact at said opening time.

3. A switch according to claim 2, wherein an end surface of said first permanent magnet opposed to said moving contact is tapered to extend on the side of said moving contact.

4. A switch according to claim 2, wherein said first permanent magnet is circumferentially enclosed with an insulator.

5. A switch according to claim 2, wherein a magnetic material disposed to extend from said end surface on the side of said moving contact is tapered to extend on the side of said moving contact.

6. A switch according to claim 1, wherein a rod-like or annular first permanent magnet is provided on an outer periphery of said fixed contact, and said first permanent magnet establishes a magnetic field to drive said arc generating between said fixed contact and said moving contact at said opening time.

7. A switch comprising:

a fixed contact;

a moving contact performing a switching operation with respect to said fixed contact;

a cylinder working with said moving contact;

a piston slidably provided in said cylinder;

a buffer chamber which is surrounded by said cylinder and said piston, and is filled with an arc-extinguishing gas;

a first insulating nozzle mounted to an end of said cylinder on the side of said fixed contact;

wherein said arc-extinguishing gas in said buffer chamber is sprayed outwardly through said nozzle on an arc generating between said fixed contact and said moving contact at an opening time of said moving contact, wherein a rod-like or annular first permanent magnet is provided in said fixed contact, and said first permanent magnet establishes a magnetic field to drive said arc generating between said fixed contact and said moving contact at said opening time.

8. A switch according to claim 7, wherein said first nozzle extends past a distal end of said moving contact, into which said fixed contact is slidably inserted at a closing time of said moving contact.

9. A switch according to claim 8, further comprising:

an annular or annularly disposed second magnet in said first insulating nozzle.

10. A switch according to claim 8, further comprising:

an electric field relaxing fixed shield formed about said fixed contact;

an electric field relaxing moving shield formed about said moving contact so as to work with said moving contact; and an annular or annularly disposed third permanent magnet in said fixed shield.

11. A switch according to claim 10, wherein said fixed shield is provided with a first gas outlet through which said arc-extinguishing gas in a vicinity of said fixed contact can flow out of said fixed shield.

12. A switch according to claim 11, wherein said cylinder is provided with a second gas outlet through which said arc-extinguishing gas in said buffer chamber can flow out of said cylinder immediately after said opening operation is started.

13. A switch according to any one of claims 10 and 11, further comprising an insulating cover to cover a distal end of said fixed shield.

14. A switch according to claim 8, further comprising:

an annular or annularly disposed second magnet on an outer periphery of said first insulating nozzle.

15. A switch according to claim 7, wherein an end surface of said first permanent magnet opposed to said moving contact is tapered to extend on the side of said moving contact.

16. A switch according to claim 7, wherein said first permanent magnet is circumferentially enclosed with an insulator.

17. A switch according to claim 7, wherein a magnetic material disposed to extend from said end surface on the side of said moving contact is tapered to extend on the side of said moving contact.

* * * * *